United States Patent [19]

Kohlenberger

[11] 4,275,478

[45] Jun. 30, 1981

[54] EXTRACTOR HEAD FOR CLEANING SOFT SURFACES SUCH AS CARPET OR UPHOLSTRY

[76] Inventor: Raymond W. Kohlenberger, 211 N. 61 Ave., Apt. #4, Hollywood, Fla. 33024

[21] Appl. No.: 80,301

[22] Filed: Oct. 1, 1979

[51] Int. Cl.[3] ..... A47L 7/00; A47L 11/34

[52] U.S. Cl. ..... 15/401; 15/322; 15/419

[58] Field of Search ..... 15/320, 321, 322, 401, 15/415 R, 419

[56] References Cited

U.S. PATENT DOCUMENTS

| | | | |
|---|---|---|---|
| 3,072,951 | 1/1963 | Kelnhofer | 15/401 X |
| 3,883,301 | 5/1975 | Emrick et al. | 15/321 X |

FOREIGN PATENT DOCUMENTS

| | | | |
|---|---|---|---|
| 48729 | 5/1934 | Denmark | 15/401 |
| 2139157 | 2/1973 | Fed. Rep. of Germany | 15/401 |
| 42318 | 3/1908 | Switzerland | 15/401 |
| 794042 | 4/1958 | United Kingdom | 15/401 |

*Primary Examiner*—Christopher K. Moore
*Attorney, Agent, or Firm*—John Cyril Malloy

[57] ABSTRACT

An extractor head for cleaning soft surfaces such as a carpeted surface or upholstry, which includes a housing defining a slit-type throat and a pivotally movable rigid squeegee pivotally mounted within the housing and extending from the throat of the extractor head to which suction is adapted to be applied and which squeegee is adapted for swinging movement in slit-type throat into and out of engagement with opposite walls of the housing depending upon the direction of the movement of the extractor head across a soft surface for the purpose of dislodging dirt and debris in so moving and sweeping, cleaning and squeegeeing the surface to remove debris and water through suction.

8 Claims, 3 Drawing Figures

EXTRACTOR HEAD FOR CLEANING SOFT SURFACES SUCH AS CARPET OR UPHOLSTRY

FIELD OF THE INVENTION

This invention relates to a surface cleaning tool and more particularly to a squeegee-type vacuum extractor head.

BACKGROUND OF THE INVENTION

In the past there have been numerous types of surface cleaning tools which are, generally speaking, vacuum cleaner type surface cleaning devices. Representative prior art is that found in the Vacuum Cleaner Floor Tool of U.S. Pat. No. 3,079,623; the Vacuum Mopping Device of U.S. Pat. No. 3,210,792; the Surface Cleaning Apparatus of U.S. Pat No. 3,332,101; the Wet Pick-up Suction Nozzle with Filter Means of U.S. Pat. No. 3,571,841 and the Cleaning Tool of U.S. Pat. No. 3,992,747. This invention, unlike the prior art and the disclosure contained in U.S. Pat. Nos. 3,079,623 and 3,210,792 provides a rigid pivotal squeegee which is utilized in a pivotal movement over a floor covering in a sweeping, mopping or squeegeeing action such as carpeted floors, upholstry and the like, which are not hard floors; the rigid swingable or pivotal squeegee is provided within the throat of the extractor tool providing an improved and different type of suction action from that of the prior art; and it includes a spray nozzle connection for the cleaning fluid; and, further, the pivotal rigid squeegee provides a deflective feature to cause the water and air movement to be positively directed.

OBJECTS OF THE INVENTION

It is an object of this invention to provide an improved tool for surface cleaning which is composed of an extractor head including a housing having a downwardly converging throat insofar as the front to rear is concerned and an outwardly diverging throat insofar as the lateral or side-to-side dimension is concerned defining a narrow slit-type throat within which there is pivotally movable a deflector type squeegee of rigid material which pivotally connected between the side walls and which spans the throat and extends from it a short distance in the order of about one-quarter of an inch so that, upon movement of the extractor head over a soft surfaced floor, it will pivotally move in one direction or the other direction opposite to that in which the tool is moved, so that, it is adapted to reach into and squeegeeingly comb a surface to be cleaned such as a rug or upholstry in counter-distinction to a hard wooden floor or linoleum surface and wherein a deflector means is provided to guide the suction and water removed from the surface and additionally wherein an attachment means is provided on the device for securing a spray nozzle to it to spray cleansing fluid or steam in the direction so as to impact adjacent the throat as it moves across a surface to be cleaned.

It is another object of this invention to provide an improved device of the type described hereinafter which is simple, inexpensive to construct and which is highly efficient and adapted for the purpose of cleaning floors and wherein a rigid swingable pivotal squeegee is provided with bleed holes to relieve the same upon changing of direction of movement of the tool and which includes a spray nozzle connection means for applying cleaning fluid such as steam or chemicals from a nozzle.

In accordance with these and other objects which have become apparent hereinafter, the instant invention will now be described with reference to the accompanying drawings in which:

DESCRIPTION OF THE PREFERRED EMBODIMENT

Figure 1:
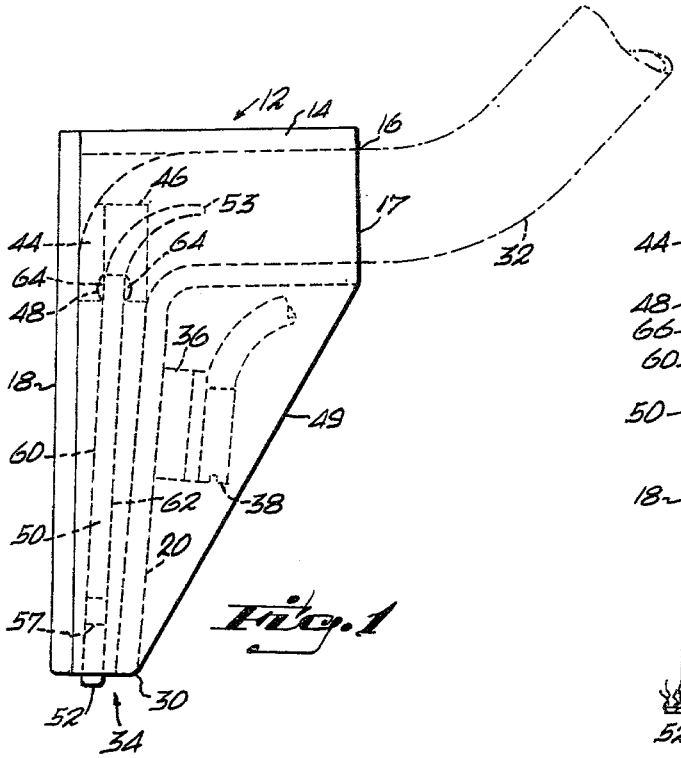
FIG. 1 is a side elevation view of the vacuum extractor head of the instant invention.
Figure 3:
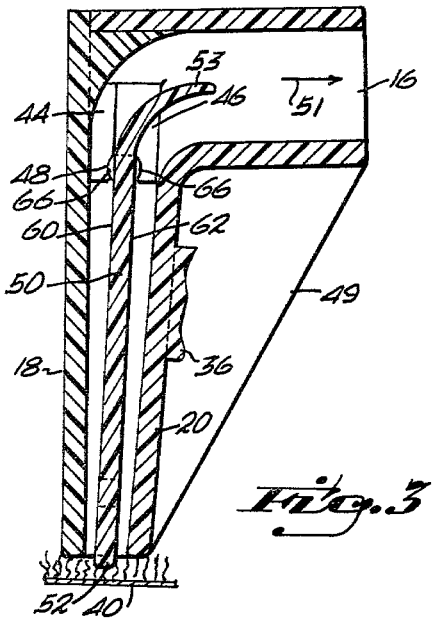
FIG. 3 is a view in cross section taken on the plane indicated by the line 3—3 of FIG. 1 and looking in the direction of the arrow.

Referring to the drawings wherein like reference characters designate like or corresponding parts throughout the several views, the head is generally designated by the numeral 12 and is seen to be composed of a housing defining a throat 17 formed with a generally circular mouth 16 at the upper end. The housing includes a top plate 14 and a front plate 18, a rear plate 20 and side walls 22 and 24. The side walls about the throat diverges downwardly to terminal ends generally indicated by the numerals 26 and 28 defining a first plane of reference together with the lower end of the front wall and which is coincident with that defined by the lower end of the rear wall 20, the terminal end of the rear wall being designated by the numeral 30. A suction pipe 32 is adapted to be connected by any suitable means into the entrance 17 of the housing at the throat. This is adapted to apply a pressure differential through the intake 34 at the lower end when suction is applied. A mounting means 36 which may be a clamp is provided on the rear plate 20 to accommodate attachment by suitable means of the terminal end of a hose with a nozzle 38 shown in dotted lines to apply a spray to a soft surface to be cleaned, such the rug generally indicated by the numeral 40 in FIG. 3.

Figure 2:
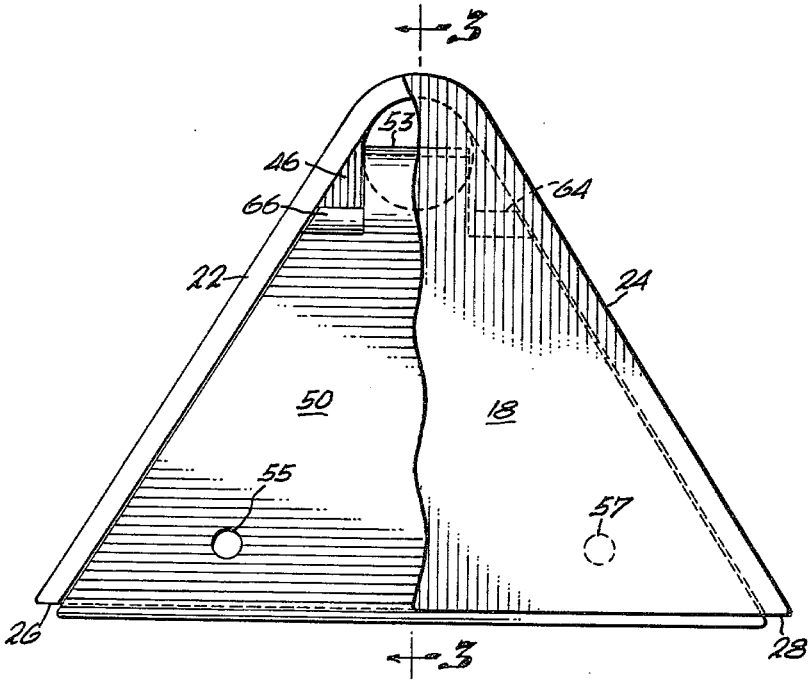
FIG. 2 is a front elevation view of the device shown in FIG. 1, which has been partly broken away to illustrate the interior portions thereof shown in dotted lines in FIG. 1.

Within the throat, in the upper zone thereof 42, there are a pair of mounting blocks, 44 and 46, preferably the block 44 being secured to the front plate and the rearmost block member 46 being secured to the side plate. These two blocks may be suitably secured together along the zone of juncture. It will be seen that these two mounting blocks, when attached to one another define a generally circular recess 48 adjacent each side wall. Also within the throat and spanning the same, as best seen in FIG. 2, is a rigid preferably plastic squeegee-flap 50 which at its lower end 52 extends slightly outwardly of the throat and extends substantially across the throat opening 34, preferably the extension being in the order of about one-eighth to one-half inch. On the upper forward and rear face 60 and 62 of the squeegee-plate 50, there are outer projections 64 and 66 respectively which are nestingly received within the recesses referred to above and which is identified by the numeral 48. Preferably the rear plate includes a reinforcing web 49.

It is thus seen that, in use, when the extractor head is moved across a floor on which steam has been sprayed from the nozzle 38, the rigid squeegee-plate will move pivotally into engagement with the either the front or, alternatively, the rear plate. By reason of its extension, the extending edge and zone will tend to have a scraping, sweeping, wiping or squeegee action supplementing, somewhat resiliently and yieldably, the suction action in the direction of the arrowed lines 51 and assisting in the collection of moisture, dirt and other debris which may be trapped in the carpet or upholstry being cleaned. Similarly, when the direction of the movement of the extractor head is reversed, the squeegee-flap will move against the opposite wall in a pivotal movement. It will be noticed that on the upper end of this squeegee-plate, there is a deflector plate 53 which is arcuate and, further, adjacent the lower zone of the squeegee-plate there are bleed holes 55 and 57 so that, on reversing of the movement, these will serve to break the suction to permit pivotal movement in operation.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. An extractor head for removing dirt and cleaning soft surfaces, such as carpet or upholstery, said head comprising a housing including a top having an interior throat diverging laterally downwardly from a suction mouth, said suction mouth being adapted for connection to a suction hose to apply suction through the throat, said housing being composed of front and rear walls spaced from one another and said front and rear walls converging downwardly toward one another defining a slit-type throat opening to sweep over a soft surface, said housing also including side walls closing the sides of the throat between the front and the rear walls, and a rigid pivotal flap-type squeegee in the throat, said squeegee including an upper end adjacent the top of the housing and a portion extending toward the suction mouth and a lower surface extending beyond the throat and beyond the front and rear walls completely across the throat between the side walls, said squeegee being of a thickness less than the distance between said front and rear walls and pivot means pivotally mounting the squeegee for swinging action, alternatively, against the rear wall or front wall, depending upon the direction of movement of the extractor head across a soft surface and wherein the squeegee plate includes holes adjacent the lower end thereof to release suction forces upon changing of the direction of the movement; said squeegee including an upper deflector zone arcuately curved and extending toward said suction mouth for directing removed fluid and debris from a soft surface and directing it toward the suction hose.

2. The device as set forth in claim 1 wherein said squeegee extends in the range of between one-quarter and one-half inch beyond the front and rear wall.

3. The device as set forth in claim 1, wherein said squeegee is of rigid plastic material.

4. The device as set forth in claim 3 wherein said housing is of rigid plastic material.

5. The device as set forth in claim 1 wherein said pivot means comprise a pair of mating journal blocks in the throat and including a pivotal recess and a portion of said squeegee pivotally nested in said recesses for said swinging movement.

6. The device as set forth in claim 1 wherein a suction hose is provided to be connected to the extractor head.

7. The device as set forth in claim 1 wherein reenforcing means in the form of a web are provided to reenforce the rear wall.

8. The device as set forth in claim 1 wherein mounting means are provided on said housing for attachment of a nozzle thereto for the purpose of securing the same for movement with the head to apply cleaning fluid, such as steam or chemical to a soft surface to be cleansed utilizing the tool.

* * * * *